US010376074B2

(12) United States Patent
Aramli

(10) Patent No.: US 10,376,074 B2
(45) Date of Patent: Aug. 13, 2019

(54) ADJUSTABLE BED LIFT MECHANISM

(71) Applicant: Mark Darius Aramli, Newport, RI (US)

(72) Inventor: Mark Darius Aramli, Newport, RI (US)

( * ) Notice: Subject to any disclaimer, the term of this patent is extended or adjusted under 35 U.S.C. 154(b) by 0 days.

(21) Appl. No.: 16/178,557

(22) Filed: Nov. 1, 2018

(65) Prior Publication Data

US 2019/0125089 A1 May 2, 2019

Related U.S. Application Data

(60) Provisional application No. 62/580,605, filed on Nov. 2, 2017.

(51) Int. Cl.
*A47C 20/04* (2006.01)
*A47C 19/02* (2006.01)
*A47C 21/06* (2006.01)

(52) U.S. Cl.
CPC ..... *A47C 20/04* (2013.01); *A47C 19/021* (2013.01); *A47C 21/06* (2013.01)

(58) Field of Classification Search
CPC ..... A47C 20/04
USPC ..... 5/613–618
See application file for complete search history.

(56) References Cited

U.S. PATENT DOCUMENTS

2008/0005836 A1* 1/2008 Kawaguchi ..... A61G 7/015 5/425

* cited by examiner

*Primary Examiner* — Fredrick C Conley
(74) *Attorney, Agent, or Firm* — Robert J. Hess; Hess Patent Law Firm

(57) ABSTRACT

A bed lift mechanism that has linkages and has an actuator connected structure that is movable from a non-actuated position to two or three actuated positions. One set of linkages lifts the bed frame with the actuator connected structure moved into an associated one of the actuated positions and then push another set of linkages as the actuator connected structure is moved into another of the actuated positions. In the case where there are three actuator positions, further linkages move down a bed frame slotted bracket to initially lift the bed frame and as they reach and end of the slotted bracket as the actuator connected structure is moved to a different actuator position, the one set of linkages pull together to lift the bed frame vertically.

28 Claims, 26 Drawing Sheets

ADJUSTABLE BED LIFT MECHANISM

CROSS-REFERENCE TO RELATED APPLICATIONS

U.S. provisional patent application No. 62/580,605, filed Nov. 2, 2017, from which the present application claims the benefit of priority.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

1. Field of Endeavor to which the Invention Pertains

The invention pertains to an adjustable bed lift mechanism that raises and lowers the head and leg elevations in beds as desired.

2. Description of Information Known to the Inventor, Including References to Specific Documents Related to the Invention, and Specific Problems Involved in the State of Technology that the Invention is Drawn Toward Adjustable bed frames, also called power adjustable bases or power beds, have become a commonplace convenience in bedrooms. The ability to raise and lower the head and legs elevations in beds have many proven benefits and comfort qualities. Typical power adjustable bed frames can lift anywhere from 450 to 800 pounds of evenly distributed weight in a bed.

The construction and design of these adjustable bed frames is nearly universally the same, consisting of a free-standing bed frame structure (typically steel tube) with 4 or 6 legs. The bed frame structure contains articulating head and feet platform sections mounted on pivots to the main frame. These articulating head and foot sections are motion controlled via linear actuators that connect from the main stationary frame and push or pull to create the platform movement.

The idealized use of a linear actuator would have the actuating force applied normal to the pivoting platform section being articulated. However, due to space clearance restrictions under these bed frames and length of required articulation, the linear actuators are typically pushing or pulling at an angle to the required motion thus not translating 100% of their force into the direction of motion. Additionally, due the same under-bed clearance restrictions, these actuators typically have short stroke lengths, such as five inches to eight inches, which must move the articulating portions of the frame distances up to three times or more the stroke length.

These issues combine to create a highly inefficient translation of actuator force into the desired direction of motion, as well as a large space claim for actuator components below the surface of the mattress. This inefficiency requires the actuators used in typical adjustable beds to have massive amounts of push/pull force (typically 6000 newtons or higher) in order for the articulating portions of the platforms to achieve their specified lifting force for each head or foot section (typically 1100 to 1700 newtons) in the direction of desired motion. This force requirement causes the actuators to be quite large and bulky. This bulkiness also contributes to the total space requirement of the bed frame and weight.

Most adjustable bed frames weigh between 120 and 200 lbs. and are very bulky to transport. This restricts delivery methods for most adjustable bed frame products to freight delivery. Freight delivery is generally very inconvenient for consumers, requiring delivery window appointments, being expensive, and generally much slower than courier parcel delivery.

Due to great weight and bulkiness of current adjustable bed frame products, at the time of delivery it may also take two workers to move the product into the bedroom and set it up, adding to the cost of the delivery and inconvenience to the consumer of having unknown people in their bedrooms. As can be appreciated, such weight, transportation and handling problems constitute deficiencies with conventional adjustable bed products.

A broad range of furniture style ornamental bedframes exist that consumers find desirable for their bedrooms. Current adjustable bed frame types are stand-alone mattress frames, with their own legs and mattress support structures. Because of this, many adjustable bed frames are not compatible with existing furniture style bedframes—requiring consumers to forgo a chosen furniture style of bedframe in favor of the limited styles available in current power adjustable bed frames.

Some adjustable bed frames claim to fit inside furniture style bed frames. However, in most of these cases consumers must modify or cut holes in the pre-existing furniture style bedframe using tools in order to make the adjustable bed frame legs and platform fit. Platform beds with storage drawers underneath the mattress are impossible to modify for use with any adjustable bed frame with legs.

Because of the above limitations of the existing adjustable bed frame technology, an improved type of adjustable bed frame product with a novel design would be desirable to consumers.

Conventional adjustable bed frames all have the actuators mounted at a significant angle away from the mattress platform, in order to gain enough force angle and moment arm to lift the bed. A larger force angle away from the mattress platform corresponds to a greater percentage of actuator force being converted into bed lifting force. The idealized lift angle would be normal to the mattress platform, but space constraints prevent this. The common adjustable bed lifting mechanism becomes completely non-feasible for lifting if the actuator is placed nearly parallel to the mattress surface (in order to achieve a low profile).

It is desired to provide an adjustable bed product that improves on the industry standard approach in adjustable beds by forgoing the free standing adjustable bed frame approach. Instead, such an improvement to the conventional adjustable bed product should be thin and have a nearly unnoticeable mechanical powered layer that slips in between any pre-existing mattress and bed frame or box spring combination, while providing the same articulation capabilities of the conventional adjustable bed frame. Thus, any existing bed frame style (including a mattress sitting on the floor) can be converted into fully adjustable capability without modification by inserting such an improved adjustable bed product underneath the mattress.

SUMMARY OF THE INVENTION

One aspect of the invention is to provide such an improved adjustable bed product as a "power layer" that distinguishes over conventional adjustable bed products. Preferably, key differences of the power layer of the present invention over conventional adjustable bed products include the following.

The power layer of the present invention has all mechanical and articulating components contained within a very thin profile (as thin as 45 mm) below the mattress surface, which contrasts with conventional adjustable bed frames that have articulating components extending up much further below the mattress surface, requiring a large space claim below the mattress surface.

The power layer of the present invention gets its primary support by laying on top of any flat surface such as a mattress box spring or platform bed, while adjustable bed frames have a free standing support structure with their own legs on the floor.

The weight of the power layer of the present invention is much less than regular adjustable bed frames and folds into a much more compact size suitable for FedEx/UPS delivery, making it cheaper faster and easier to deliver, as well as more convenient for the consumer to move themselves into the bedroom.

The power layer of the present invention requires little or no assembly, only unpacking from box, unfolding and slipping under mattress. Adjustable bed frames require some assembly with tools after unpacking.

The power layer of the present invention uses a special multi-stage mechanism to transmit lifting loads to the frame from the actuator, while adjustable bed frames have directly connected actuators pushing or pulling on moment arms or brackets solidly welded to the frame. The unique linkage assembly is the foundation of the ability of the power layer of the present invention to provide the same lifting force as adjustable bed frames in a much more compact size.

The power layer of the present invention has nested frame elements for compact size, many adjustable bed frames have articulating frames laying on top of structure support frames.

Conventional adjustable bed frames have mattress retainer bar at the foot of the bed which presents a nuisance for changing fitted sheets and gives and unsightly "hospital bed" appearance after fitted sheet is placed on mattress. The power layer in accordance with the invention has a pivoting mattress retainer bar that is configured and arranged such that placing the fitted sheet is easier than otherwise without and after the fitted sheet is made, the retainer bar is hidden under the sheet.

The adjustable bed frame in accordance with the invention has a fixed portion and has an articulating portion pivotally connected to the fixed portion so that as the articulating portion pivots relative to the fixed portion, an angle of inclination between the articulating portion and the fixed portion changes. There are lift mechanisms that actuate in succession to exert a respective lifting force on the articulating portion to widen the angle of inclination in succession. An actuator connected structure moves relative to the fixed portion of the bed frame from a non-actuated position to successive actuated positions where the actuator connected structure imparts an actuation force on at least one of the lift mechanisms so that the lift mechanisms impart the lifting force on the articulating portion accordingly.

BRIEF DESCRIPTION OF THE DRAWINGS

For a better understanding of the present invention, reference is made to the following description and accompanying drawings, while the scope of the invention is set forth in the appended claims.

FIGS. 27 and 28 omit depiction of the bed frame.

DETAILED DESCRIPTION OF THE INVENTION

Figure 1:
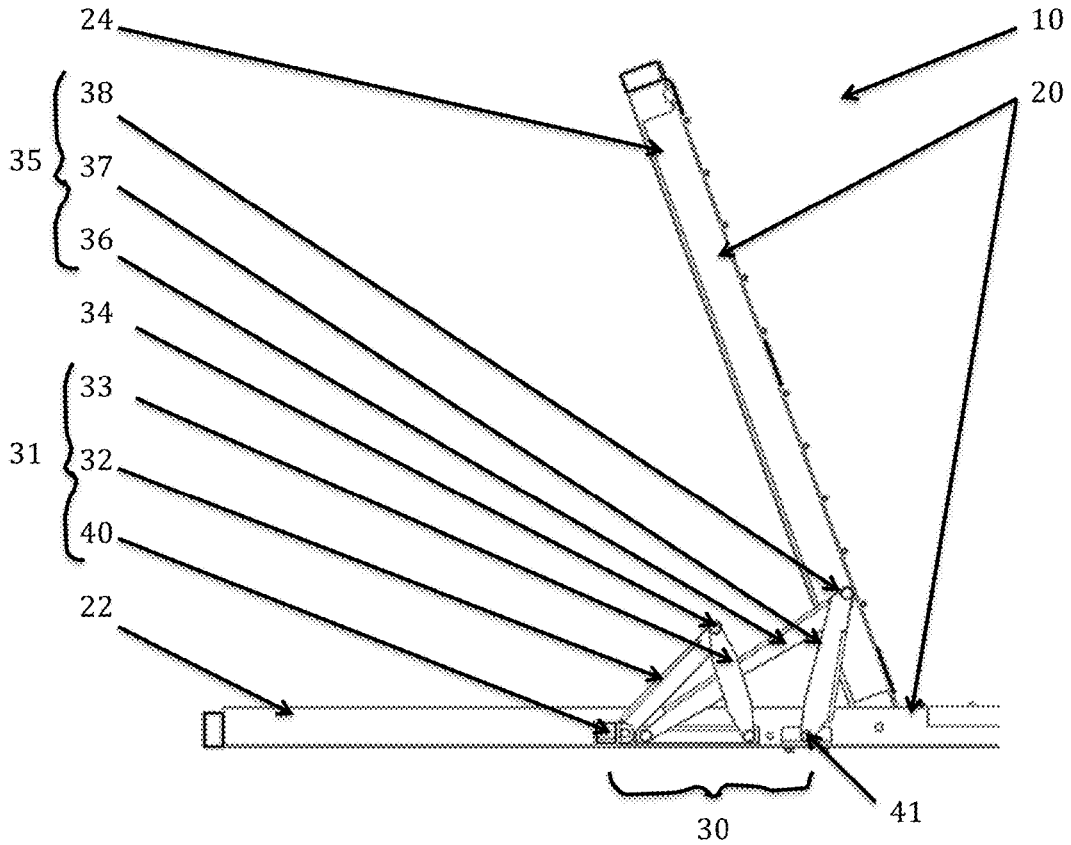
FIG. 1 is a cross section of a bed frame together with an elevation view of a bed lift having an articulated linkage system in the bed frame in accordance with an eight-bar articulated linkage embodiment of the invention.

The basic principle behind the concept of the power layer in accordance with the invention rests on a unique multi-stage mechanism concept that enables the actuator to be placed in parallel or near parallel with the mattress surface, while still transmitting sufficient force to lift the bed. This allows the power layer of the present invention to achieve its unprecedented thin profile.

The lifting mechanism of the power layer of the present invention includes a first stage and second stage mechanism tied to a single actuator. The first stage mechanism is optimized to lift the bed from flat up to a certain distance and angle. As a result, an angle of inclination between the articulating portion 24 of the bed frame 20 and the fixed portion 22 of the bed frame 20 widens as the actuator connected structure moves from its non-actuated position to its first-stage actuated position.

This first stage is designed to most efficiently transmit maximum force from the actuator to the bed while the bed is nearly flat or only partially lifted. However, the limitation of this optimization is that the first stage cannot complete the full travel lifting of the bed, which typically would be 60 to 70 degrees for the head section.

Once that maximum lifting angle is achieved by the first stage, a second stage mechanism that is optimized to lift the bed past maximum first stage angle takes over that lifts the bed the remainder of its intended travel. The second stage mechanism is optimized for lifting once the bed has already been lifted to the angle of the first stage mechanism. As a result, the angle of inclination between the articulating portion 24 of the bed frame 10 and the fixed portion 22 of the bed frame 12 further widens as the actuator connected structure 40 moves from its first-stage actuated position to its second-stage actuated position. The actuator connected structure pulls a "pull-bar 40", which connects to the linkages. The pull-bar 40 travels along a channel in the fixed portion of the bed frame and has a smooth and continuous movement, allowing infinite number of bed articulated positions.

In one approach, the first stage mechanism multiples force transmission at a greater amount from the actuator than the second stage. This means the first stage will lift the bed more slowly than the second stage with the actuator connected at the same speed through both stages.

Multiple methods exist for to create an optimized first stage lift mechanism (wedges pulled against an incline surface, linkage arms, scissor jack, etc.). In one embodiment, a half scissor jack approach is used with sufficient pre-load angle within the low profile frame of the power layer of the present invention to transmit actuator force from horizontal to vertical for lifting the bed.

Turning to the drawings, three different bed frame lifting linkage systems are depicted in accordance with the invention. Each operates under the same guiding principle of dividing the lift into two (or more) stages of lift to reduce the maximum force required to lift the bed from an actuator, e.g., by pushing a preceding stage of lift into a successive one to cause the successive one to lift. Each stage is a unique lifting mechanism that varies in lifting capacity output and range of motion. Each stage is strategically located in the system for efficiency gains.

FIG. 1 is an overview of a bed lift 10 in accordance with an eight-bar embodiment of the invention that includes a bed frame 20 and an eight-bar articulated linkage 30 in the bed frame 20. The bed frame 20 includes a fixed (inner) portion 22 and an articulating (outer) portion 24 that are pivotally attached to each other. There are first- and second-stage lift mechanisms 31, 35 that are actuated respectively by moving the pull bar 40 to the actuator connected structure accordingly from a non-actuated position to a first-stage actuated position that actuates the first-stage lift mechanism 31 and then to a second-stage actuated position that actuates the second-stage lift mechanism 35. The pull bar 40 to actuator connected structure may pulled to move its actuator or alternatively pushed.

The first-stage lift mechanism 31 includes articulated linkages 32, 33, which pivot about a first-stage lift pivot 34 and are pivotally connected to the fixed (inner) portion 22 of the bed frame 20. The second-stage lift mechanism 35 includes the articulated linkages 36, 37, which pivot about a second-stage lift pivot 38 and are pivotally connected to the fixed (inner) portion 22 of the bed frame 20. For instance, the linkage 37 is pivotally connected at one end to the bed frame 20 at pivot 41.

Figure 2:
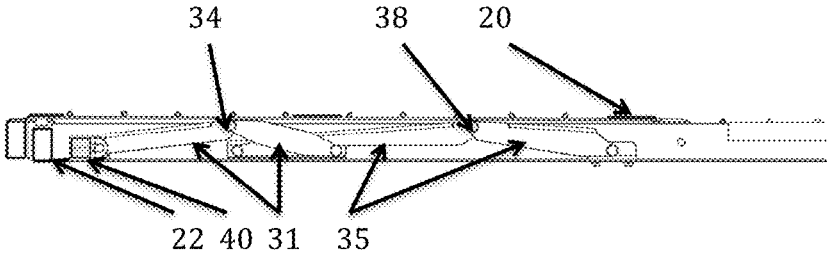
FIG. 2 is an elevation view of a flattened state of the bed lift of FIG. 1 in accordance with the eight-bar articulated linkage embodiment of the invention.
Figure 3:
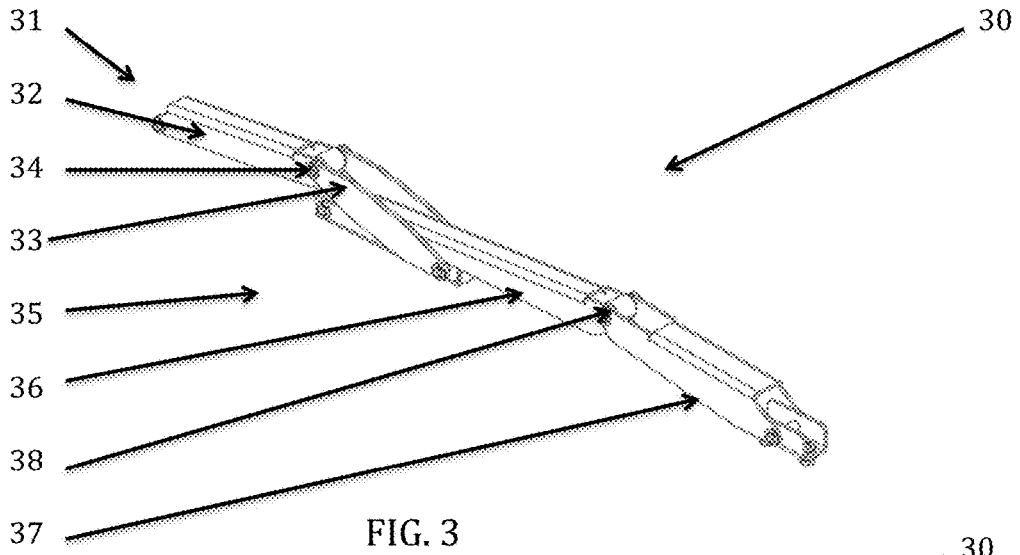
FIGS. 3 and 4 are respective isometric and elevations views of the bed lift of FIG. 1 in the flattened state except that the bed frame is omitted.
Figure 4:
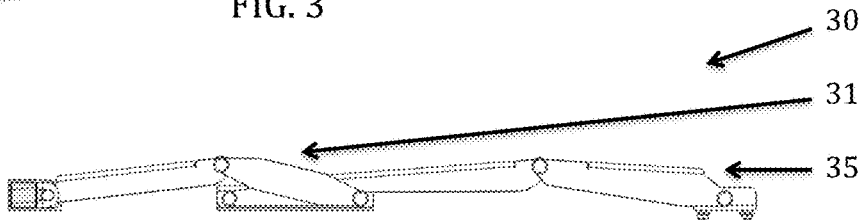

In the non-actuated position of the actuator connected structure 40, the eight-bar articulated linkage 30 is in a flattened state of FIGS. 2-4. In the first-stage actuated position of the actuator connected structure, the eight-bar articulated linkage 30 moves out of the flattened state and into an actuated first-stage. In the second-stage actuated position of the actuator connected structure, the eight-bar articulated linkage moves out of the actuated first-stage and into an actuated second-stage.

Figure 5:
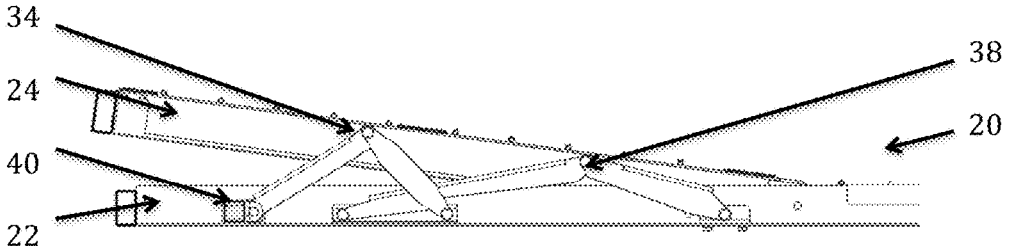
FIG. 5 is a cross section view of the bedframe and an elevation view of an actuated first-stage of the bed lift of FIG. 1 in accordance with the eight-bar articulated linkage embodiment of the invention.
Figure 6:
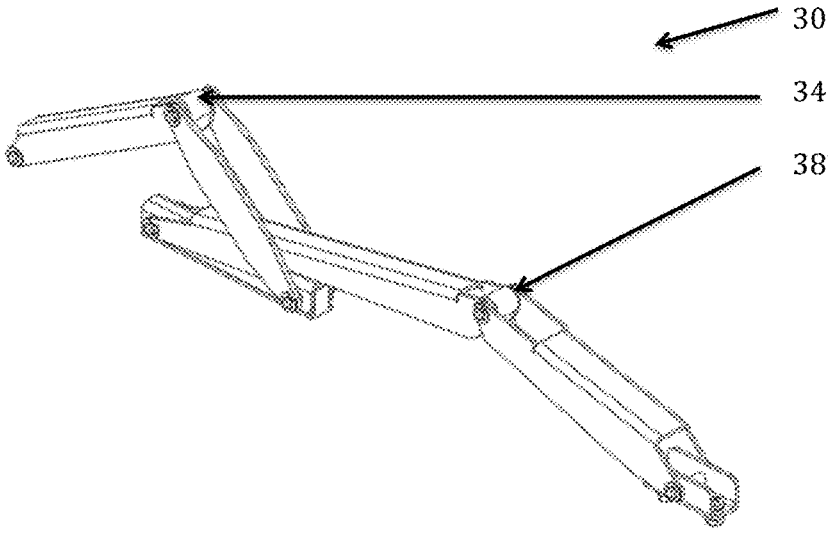
FIGS. 6 and 7 are respective isometric and elevation views of the bed lift of FIG. 5 in the actuated first-stage of the bed lift except that the bed frame is omitted.
Figure 7:
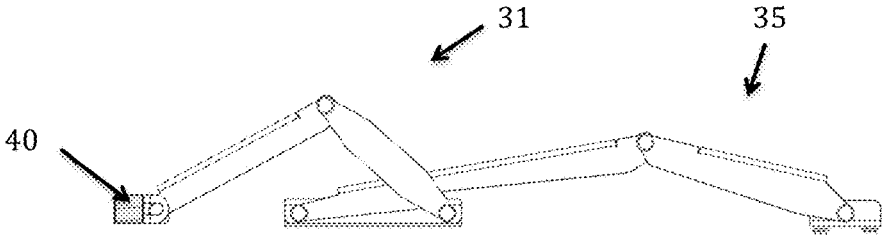

FIG. 5 shows an actuated first-stage of the bed lift that has the eight-bar linkage 30, which state is realized by moving the actuator pulling structure (pull bar 40) horizontally by an appropriate amount, causing the first-stage linkages to lift vertically to lift the bed frame 20. In this first-stage of the bed lift 10, the lifting force is generated from the first-stage lifting mechanism 31 of the eight-bar articulated linkage 30. The second-stage lift pivot 38 may or may not make contact with the bed frame 20 when the bed lift is in the actuated first-stage. Regardless of whether there is such contact, the majority of the lifting force is located at the first-stage lift pivot 34. FIGS. 6 and 7 show the eight-bar articulated linkage 30 alone after the actuator connected structure reaches the first-stage actuated position, but FIGS. 6 and 7 omit depiction of the bed frame for the sake of mechanism clarity.

Figure 8:
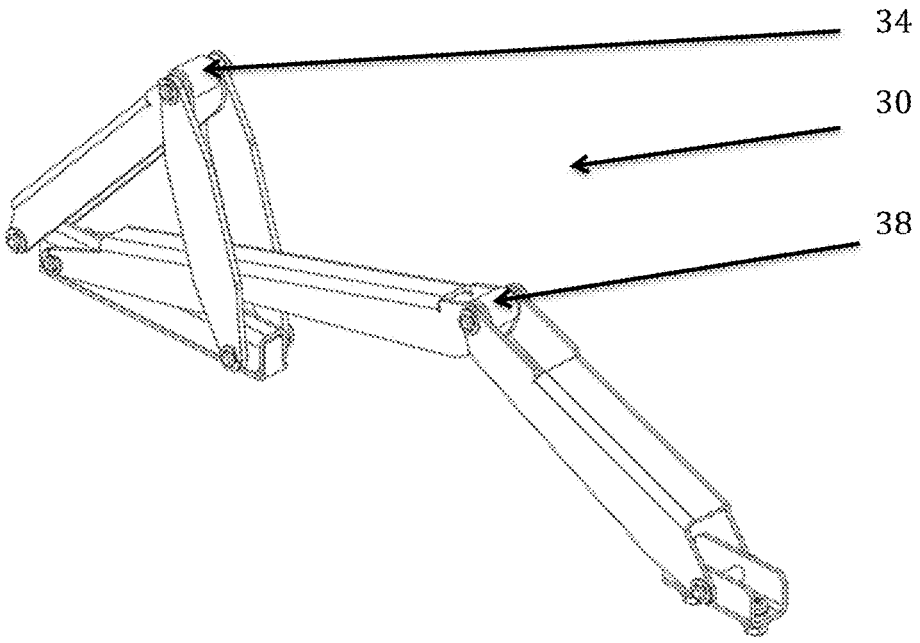
FIGS. 8 and 9 are respective isometric views showing a transition from the actuated first-stage to an actuated second-stage in accordance with the eight-bar linkage embodiment of the invention.
Figure 9:
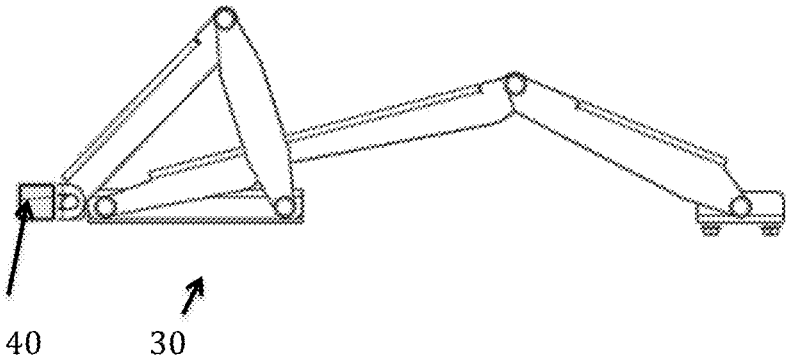

FIGS. 8 and 9 respectively show a transition from the actuated first-stage of FIG. 5 to an actuated second-stage, both with respect to the eight-bar articulated linkage 10. No bed frame is shown for the sake of mechanism clarity.

Figure 10:
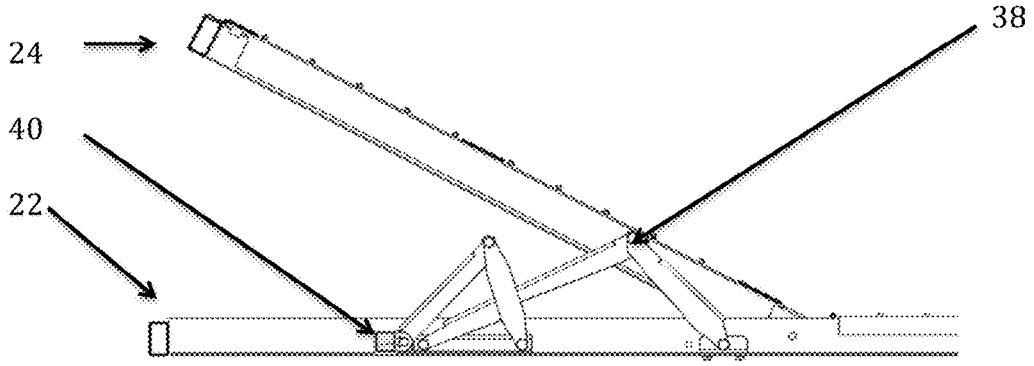
FIG. 10 is a cross section view of an actuated second-stage of the bed lift of FIG. 1 in accordance with the eight-bar articulated linkage embodiment of the invention.
Figure 11:
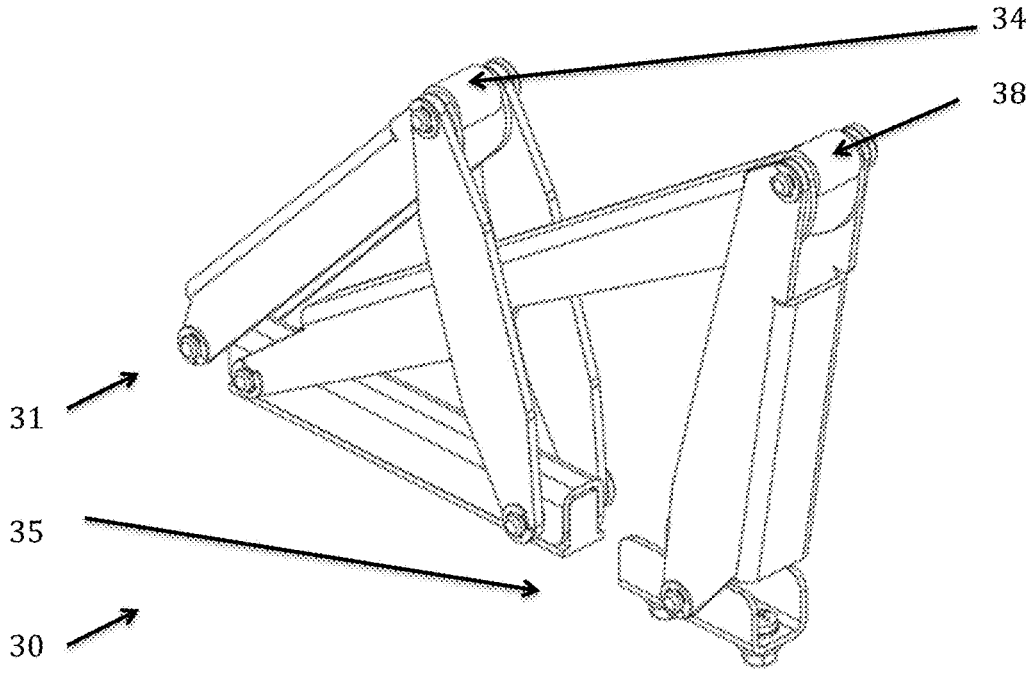
FIGS. 11 and 12 are respective isometric and elevations view of the bed lift of FIG. 10 in the actuated second-stage of the bed lift except that the bed frame is omitted.
Figure 12:
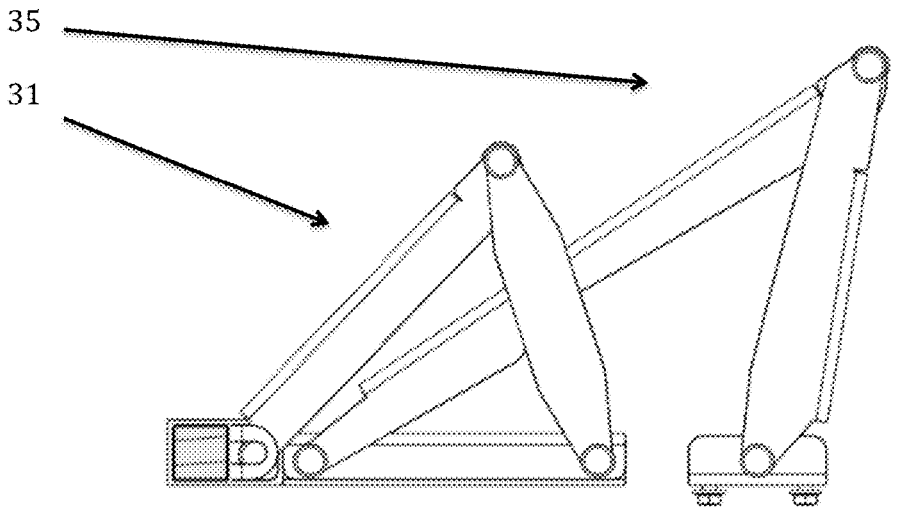

FIG. 10 shows an actuated second-stage of the bed lift 10 that has the eight-bar linkage 30, which state is realized by moving the actuator pulling structure (pull bar 40) further horizontally to push the second-stage linkages 36, 37 of the second-stage lifting mechanism 35, which causes them to lift vertically. That is, the lifting force is generated from the second-stage linkages 36, 37 at their second-stage lift pivot 38. The first-stage lift pivot 34 no longer makes contact with the bed frame 20 and all force is generated at the second-stage lift pivot 38. FIGS. 11 and 12 show the eight-bar articulated linkage 30 alone after the actuator connected structure reaches the second-stage actuation position, except that FIGS. 9 and 10 omit depiction of the bed frame for the sake of mechanism clarity.

The bed is kept upright by a actuator connected structure self-braking feature. The actuator connected structure has a natural resistance with not power to being back-driven. That is, when power is removed from actuator, the normal force on the bed frame is less than the force required to back-drive the actuator connected structure, which is what holds the bed upright. In order to lower the bedframe, the actuator connected structure is reversed under power.

Figure 13:
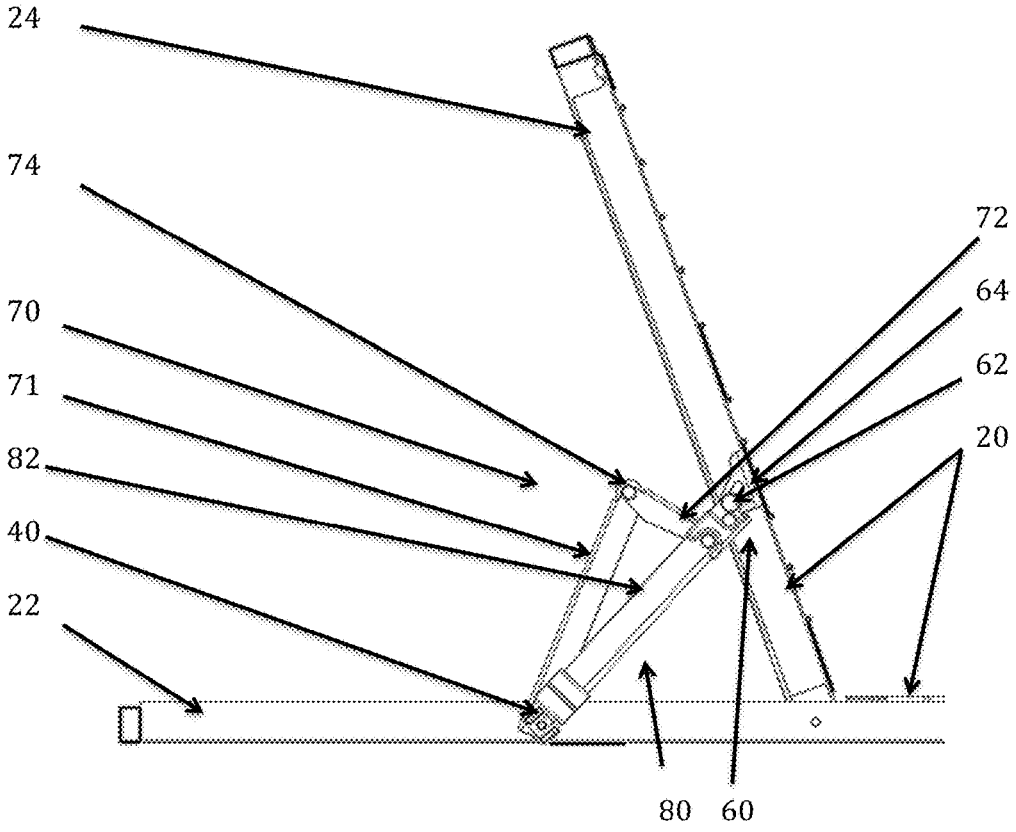
FIG. 13 is a cross section of a bed frame together with an elevation view of a bed lift having an articulated linkage system in the bed frame in accordance with a six-bar articulated linkage embodiment of the invention.

FIG. 13 is an overview of a six-bar embodiment of the bed lift in accordance with the invention that has a six-bar articulated linkage 50 in the bed frame 20. As in the previous embodiment, the bed frame 20 includes a fixed (inner) portion 22 and an articulating (outer) portion 24 that are pivotally attached to each other. However, there are first-, second- and third-stage lift mechanisms 60, 70, 80 that are actuated by moving an actuator connected structure accordingly from a non-actuated position to, in succession, corresponding first, second and third actuated positions.

The first-stage lift mechanism 60 has a lifting wedge 62 that engages with a slot bracket 64 of an articulating portion of the bed frame 20. The second stage lift mechanism 70 has articulated linkages 71, 72 that can pivot about a second stage lift pivot 74. The third stage lift mechanism 80 includes a linkage 82.

Figure 14:
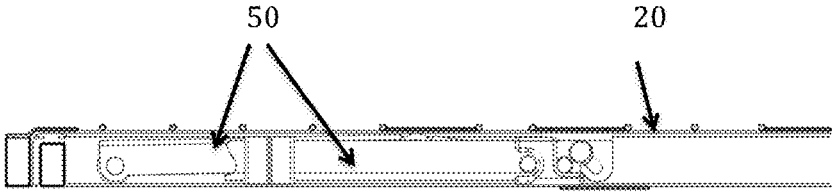
FIG. 14 is an elevation view of a flattened state of the bed lift of FIG. 13 in accordance with the six-bar articulated linkage embodiment of the invention.
Figure 15:
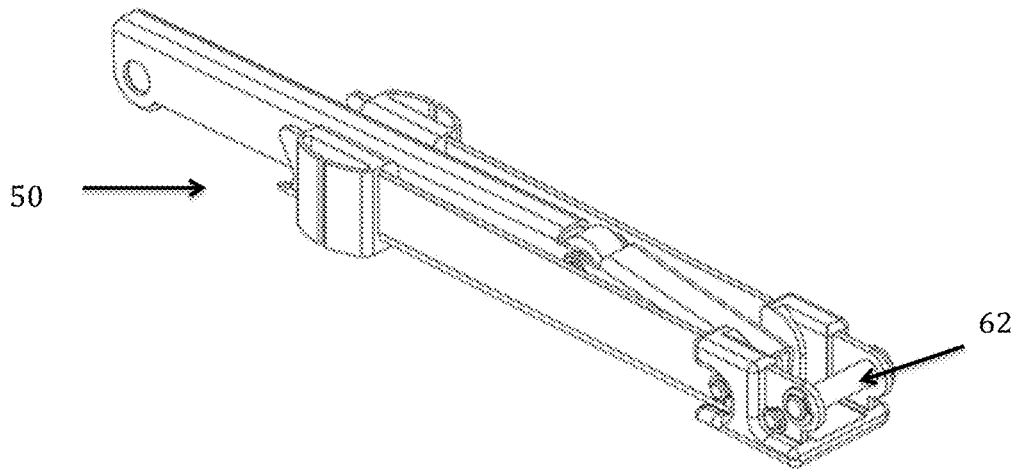
FIGS. 15 and 16 are respective isometric and elevation views of the bed lift of FIG. 11 and of a slot bracket from an articulating portion of the bed frame, but omitting a remainder of the bed frame.
Figure 16:
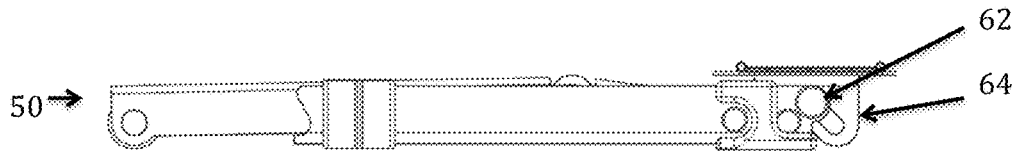

FIG. 14 shows a flattened state of the bed lift that has the six-bar articulated linkage 50 in the bed frame 20. The six-bar articulated linkage 50 nests within the bed frame 20 and itself to lay flat. FIGS. 15 and 16 show the six-bar articulated linkage 50 in the flattened condition and show the articulating portion of the bed frame 20 that has the slot bracket 64, but they omit depiction of the rest of the bed frame for the sake of mechanism clarity.

Figure 17:
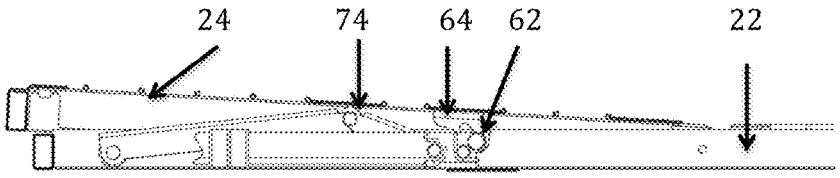
FIG. 17 is a cross section view of an actuated first-stage of the bed lift of FIG. 13 in accordance with the six-bar articulated linkage embodiment of the invention.
Figure 18:
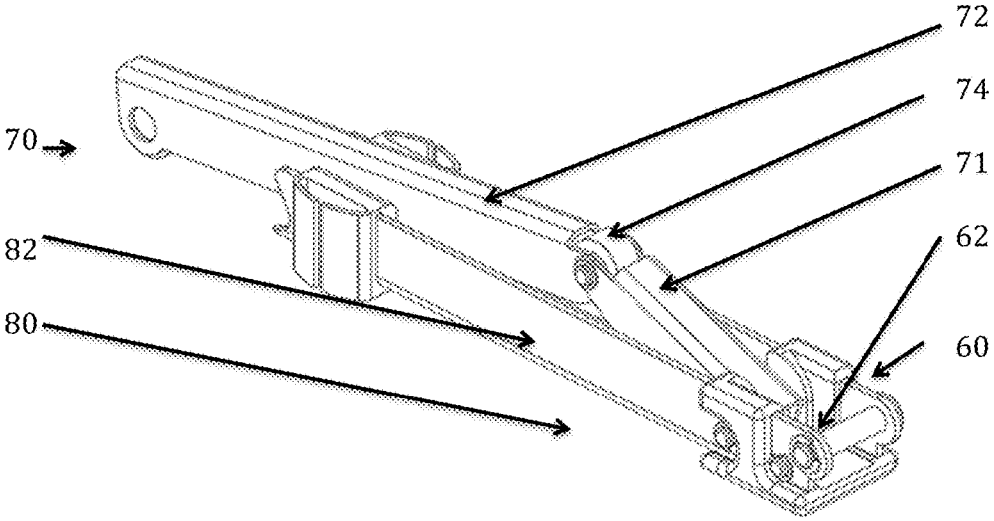
FIGS. 18 and 19 are respective isometric and elevation views of the bed lift of FIG. 13 except that the bed frame is omitted.
Figure 19:
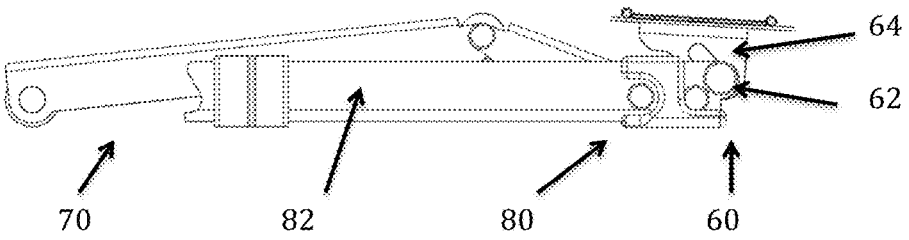

FIG. 17 shows an actuated first-stage of the bed-lift that has the six-bar articulated linkage 50 in the bed frame 20, which state is realized from moving the actuator connected structure horizontally to a first-stage actuator position. FIGS. 18 and 19 show the six-bar articulated linkage 50 alone after the actuator connected structure reaches the first-stage actuation position as well as the articulating portion of the bed frame 20 that has the slot bracket 64, but they omit depiction of the rest of the bed frame for the sake of mechanism clarity.

In the first portion of the bed lift, the lifting force is generated from the first-stage slotted bedframe bracket 64. The entire actuator linkage assembly moves horizontally, causing the linkages to move down the slot in the first-stage slotted bedframe bracket 64 and consequently lifts the bed frame 20 vertically. The second-stage lift pivot 74 may or may not make contact with the bed frame 20. Regardless of contact, the majority of the lifting force is located at the first-stage slotted bedframe bracket 64. As a consequence, an angle of inclination between the articulating portion 24 of the bed frame 10 and the fixed portion 22 of the bed frame 10 widens.

Figure 20:
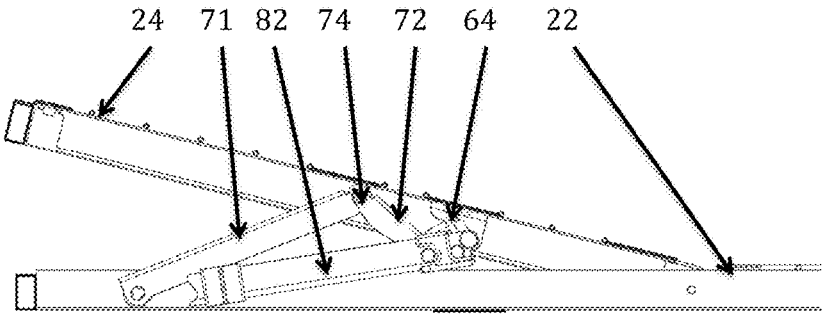
FIG. 20 is a cross section of the bedframe together with an elevation view of an actuated second-stage of the bed lift of FIG. 13 in accordance with the six-bar articulated linkage embodiment of the invention.
Figure 21:
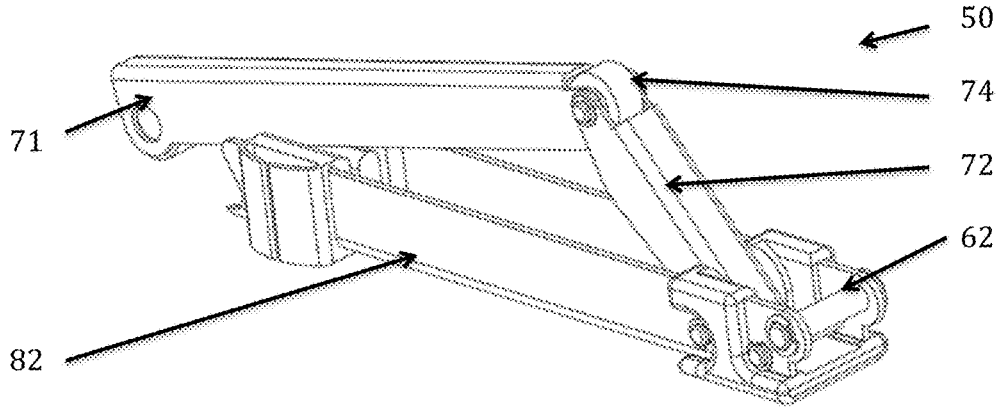
FIGS. 21 and 22 are respective isometric and elevation views of the bed lift of FIG. 18 except that the bed frame is omitted.
Figure 22:
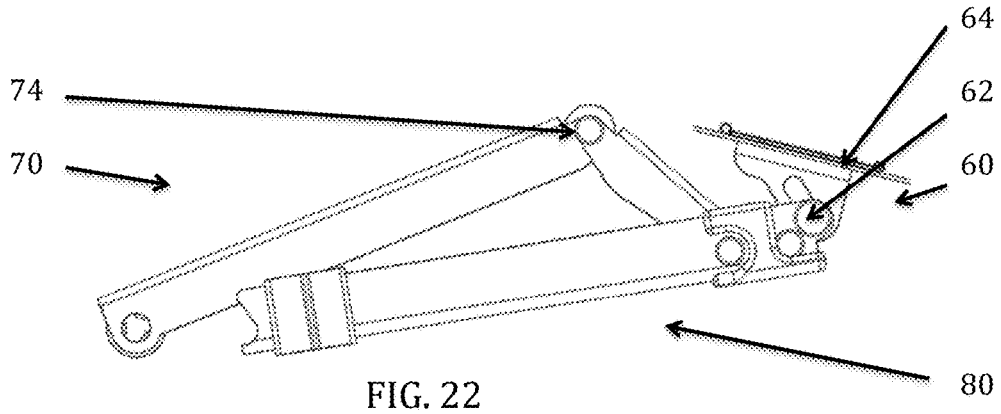

FIG. 20 shows an actuated second-stage of the bed-lift 10 that has the six-bar articulated linkage 50 in the bed frame 20, which state is realized from moving the actuator connected structure horizontally further to a second-stage actuator position. FIGS. 21 and 22 show the six-bar articulated linkage 50 after the actuator connected structure reaches the second-stage actuation position as well as the articulating portion of the bed frame 20 that has the slot bracket 64, but they omit depiction of the rest of the bed frame for the sake of mechanism clarity.

In the second stage of the bed lift, the lifting force is generated from the second-stage linkages 71, 72. After these linkages 71, 72 move down the slot to the end, the actuator connected structure's horizontal motion causes the linkages to pull together lifting the bedframe vertically further. The majority of the lifting force is located at the second-stage lift pivot 74. As a consequence, an angle of inclination between the articulating portion 24 of the bed frame 10 and the fixed portion 22 of the bed frame 10 widens further.

Figure 23:
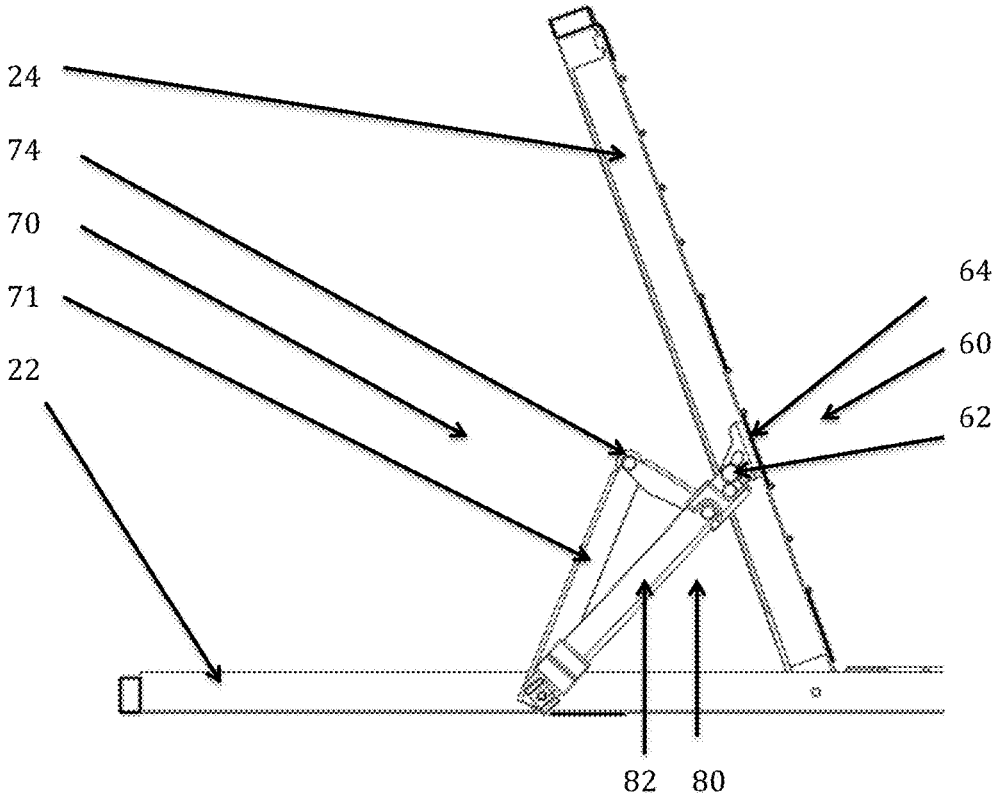
FIG. 23 is a cross section of the bedframe together with an elevation view of an actuated third-stage of the bed lift of FIG. 13 in accordance with the six-bar articulated linkage embodiment of the invention.
Figure 24:
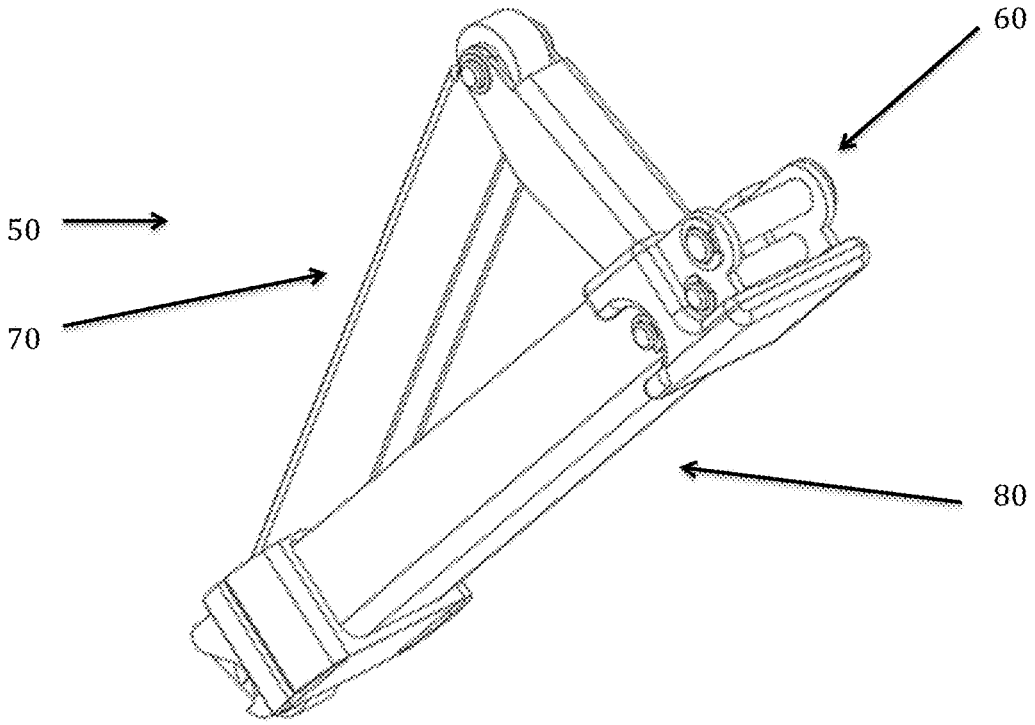
FIGS. 24 and 25 are respective isometric and elevation views of the bed lift of FIG. 21 except that the bed frame is omitted.
Figure 25:
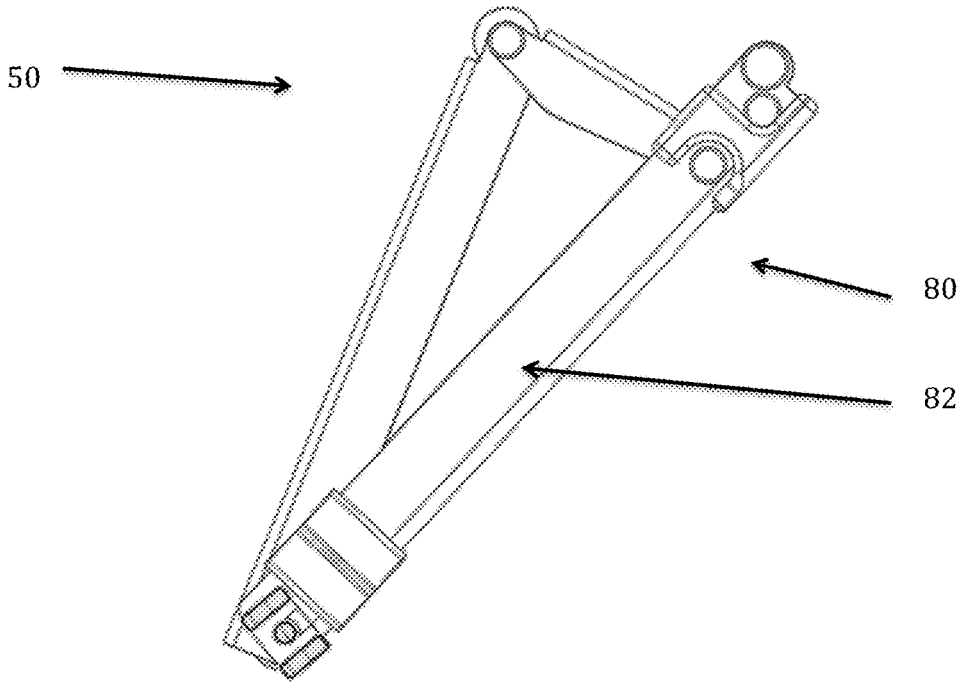

FIG. 23 shows the bed frame with the six-bar articulated linkage but in an actuated third-stage. FIGS. 24 and 25 show the six-bar articulated linkage 50 after the actuator connected structure reaches the third-stage actuation position as well as the articulating portion of the bed frame 20 that has the slot bracket 64, but they omit depiction of the rest of the bed frame for the sake of mechanism clarity.

In the third-stage of the bed lift, the lifting force is generated from the third stage linkage 82. The actuator pulling structure (pull bar 40) moves further horizontally to push the third-stage linkage 82, which causes it to lift vertically. The second-stage lift pivot 74 no longer makes contact with the bed frame and all force is generated at the third-stage lift pivot 84. As a consequence, an angle of inclination between the articulating portion 24 of the bed frame 10 and the fixed portion 22 of the bed frame 10 widens additionally.

Figure 26:
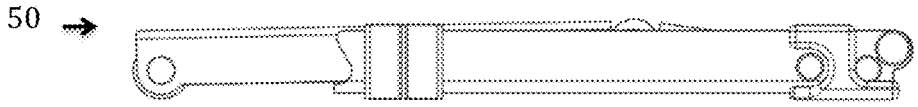
FIGS. 26, 27 and 28 are respective elevation views showing a transition for the six-bar articulated linkage embodiment of the invention from the non-actuated state of FIG. 26 to the actuated first-stage of FIG. 27 to the actuated second-stage of FIG. 28.
Figure 27:
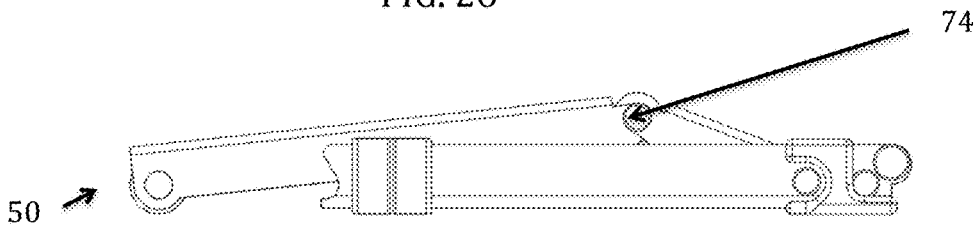
Figure 28:
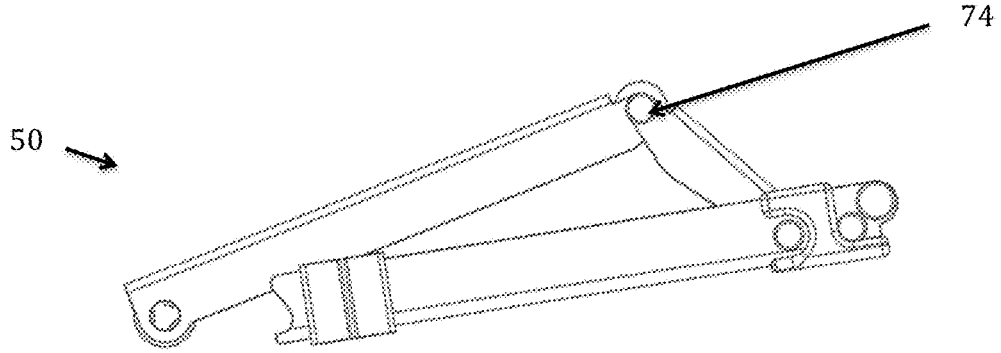
Figure 29:
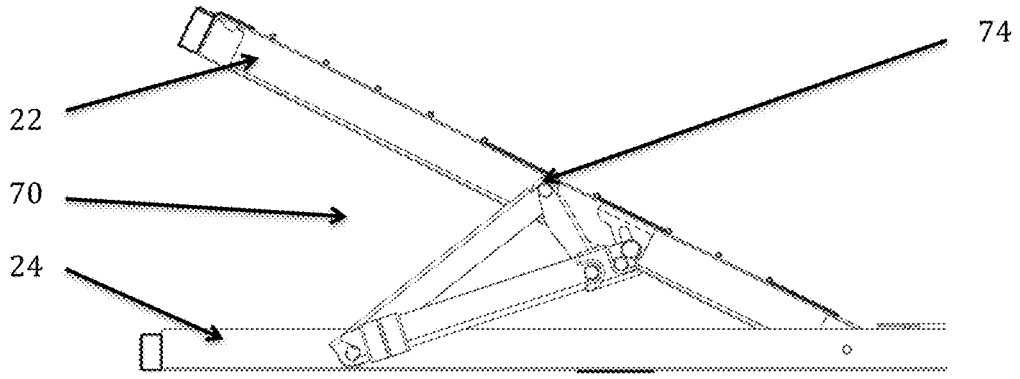
FIG. 29 is an elevation view of a transition between the actuated second-stage of the six-bar linkage of FIG. 20 and the actuated third-stage of the six-bar articulated linkage embodiment of FIG. 23.
Figure 30:
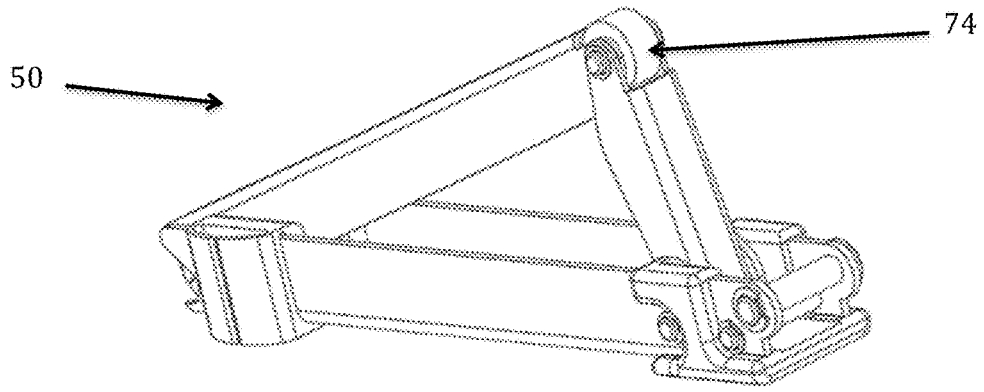
FIGS. 30 and 31 are respective isometric and elevations views of the six-bar linkage in the transition of FIG. 29.
Figure 31:
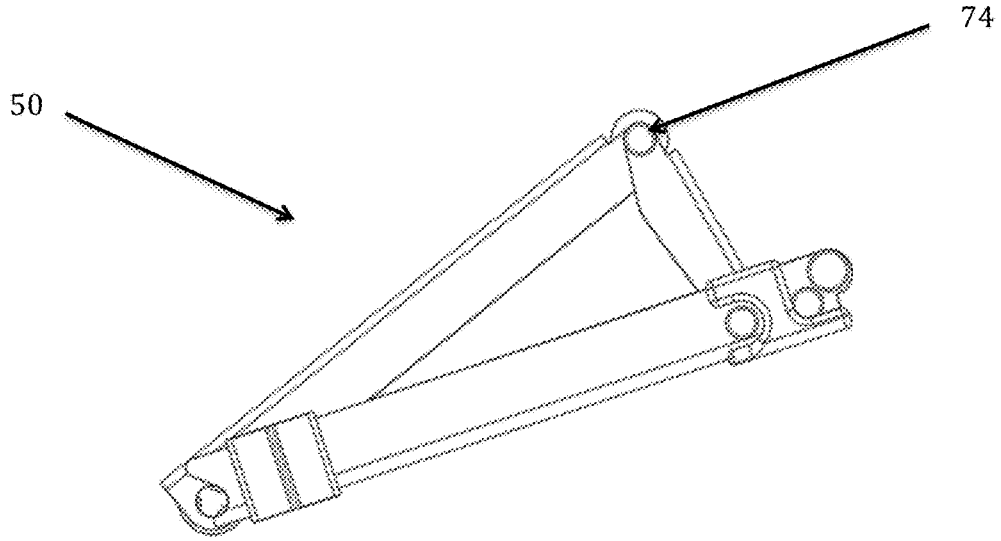

FIGS. 26, 27 and 28 show a transition from the first-stage to the second stage for the six-bar articulated linkage. FIGS. 29, 30 and 31 pertain to depiction of a transition between the actuated second-stage of the six-bar linkage of FIG. 20 and the actuated third-stage of the six-bar linkage of FIG. 23. Neither the bed frame nor the slot bracket is shown in FIGS. 30 and 31 for the sake of mechanism clarity.

Preferably, the actuator is in parallel or "nearly" parallel to the mattress surface when bed frame is flat. That is, "nearly" being defined as within a few degrees. Also, when fully actuated, the actuator pivots only a tiny amount, less than 2 degrees, and fully within the confines of the bedframe thickness of 45 mm. In contrast, conventional actuators pivot quite a bit more during travel.

All articulating components are preferably confined to being above the bottom surface of the articulation portion of the bedframe during all stages of travel. Also linkages for stage 1 and stage 2 are nested, allowing for smaller space claims.

Also, in the preferred embodiment of the 8-bar linkage, the lifting points from the linkage stage 1 and stage 2 push up on the articulating portion of the bedframe for lift—but they are not attached to the articulating portion of the bedframe. Instead, they are allowed to slide along the underside of it during lift. That is, the bedframe can be lifted at any time off the stage 1 and stage 2 linkages. This is an important safety feature—when the actuator is driven in reverse to lower the bedframe, the articulating portion of the frame is being driven down by gravity and not forced down by the actuator, which could cause a safety problem if any pets or limbs were accidentally stuck under the bed frame. Conventional adjustable bedframes have this feature—but none of them combine it with the multi-stage lifting mechanism of the present application.

Figure 32:
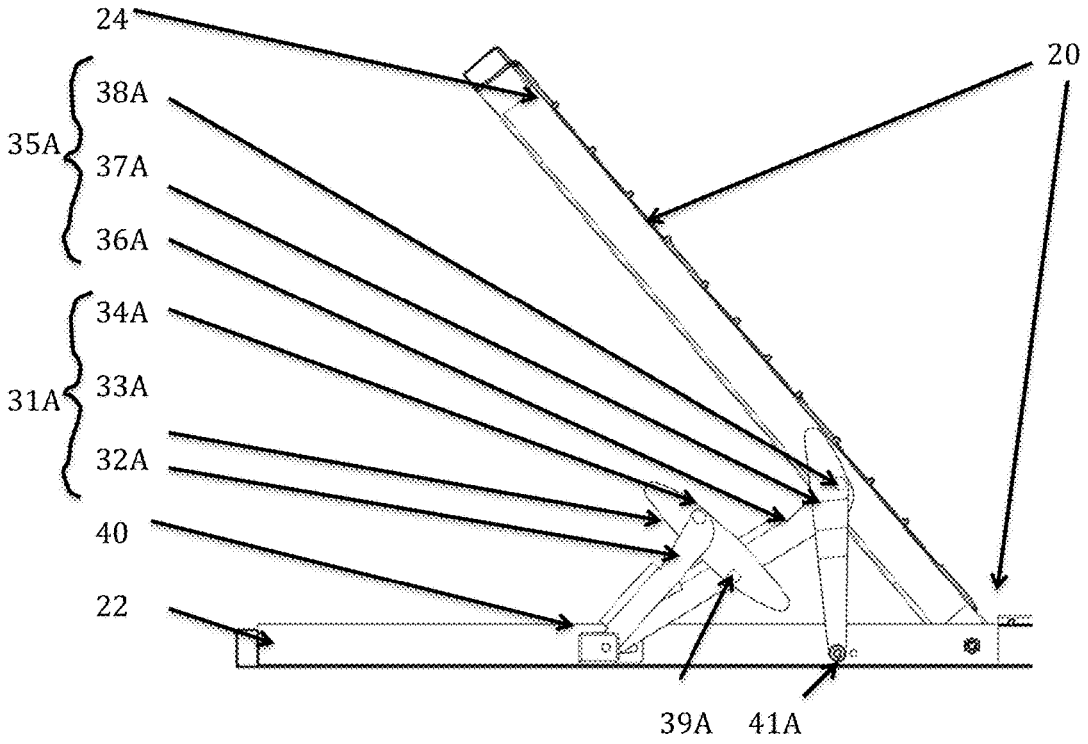
FIG. 32 is a cross section of a bedframe together with an elevation view of a bed lift having an articulated linkage system in the bed frame in accordance with a double wing linkage embodiment of the invention

FIG. 32 is an overview of a bed lift 10 in accordance with a double wing embodiment of the invention that includes a bed frame 20, a double wing articulated linkage 30A in the bed frame 20, and an actuator connected structure. The bed frame 20 includes a fixed (inner) portion 22 and an articulating (outer) portion 24 that are pivotally attached to each other. There are first- and second-stage lift mechanisms 31A, 35A that are actuated respectively by moving the actuator connected structure accordingly from a non-actuated position to a first-stage actuated position that actuates the first-stage lift mechanism 31A and then to a second-stage actuated position that actuates the second-stage lift mechanism 35A.

Figure 33:
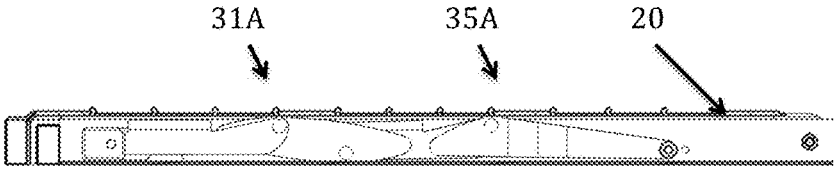
FIG. 33 is an elevation view of a flattened state of the bed lift of FIG. 32.
Figure 34:
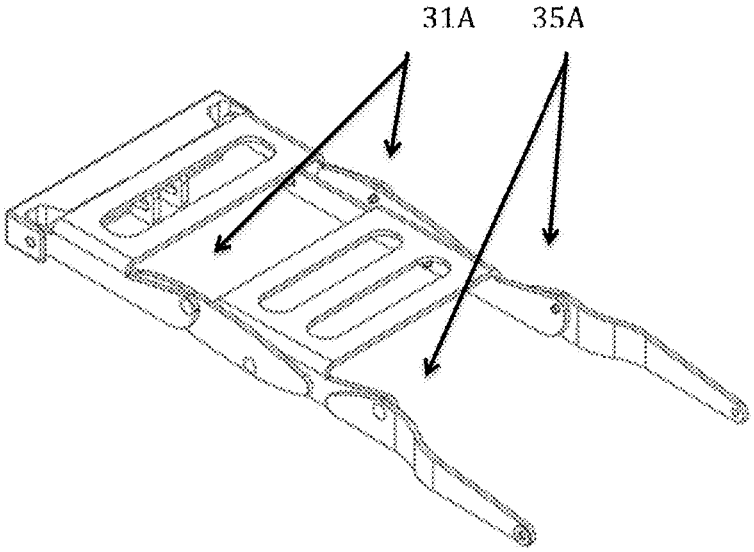
FIGS. 34 and 35 are respective isometric and elevations views of the bed lift of FIG. 32 in the flattened state except that the bed frame is omitted.
Figure 35:
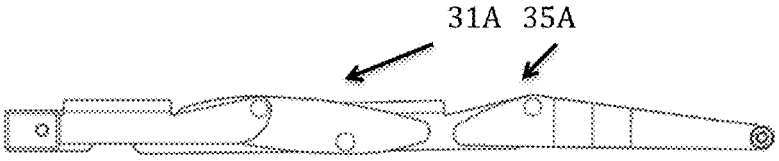

In the non-actuated position of the actuator connected structure, the double wing articulated linkage 30A is in a flattened state of FIGS. 33-35. In the first-stage actuated position of the actuator connected structure, the double wing articulated linkage 30A moves out of the flattened state and into a first-stage actuated state. In the second-stage actuated position of the actuator connected structure, the double wing articulated linkage moves out of the first-stage actuated state and into a second-stage actuated state.

Figure 36:
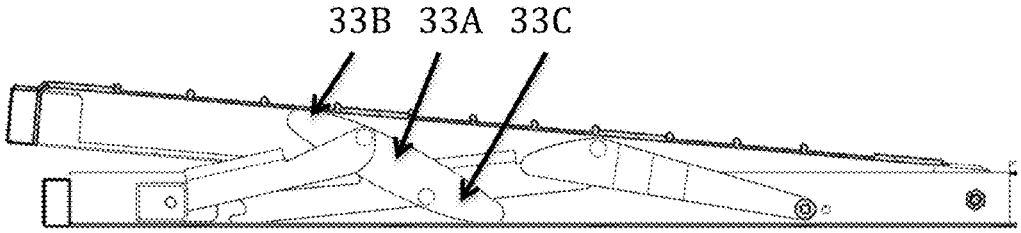
FIG. 36 is a cross section view of an actuated first-stage of the bed lift of FIG. 32.
Figure 37:
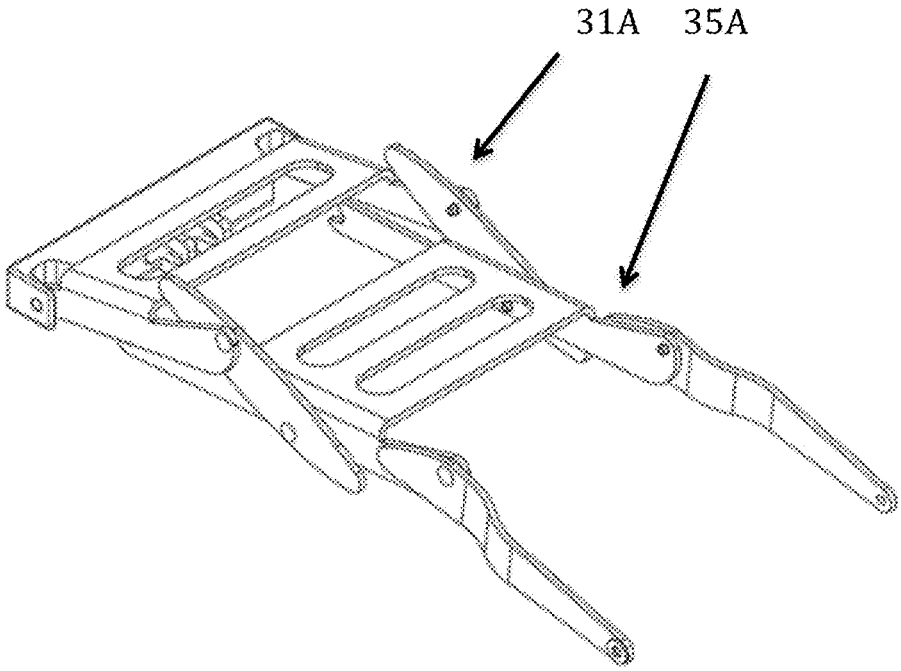
FIGS. 37 and 38 are respective isometric and elevation views of the bed lift of FIG. 36 in the actuated first-stage of the bed lift except that the bed frame is omitted.
Figure 38:
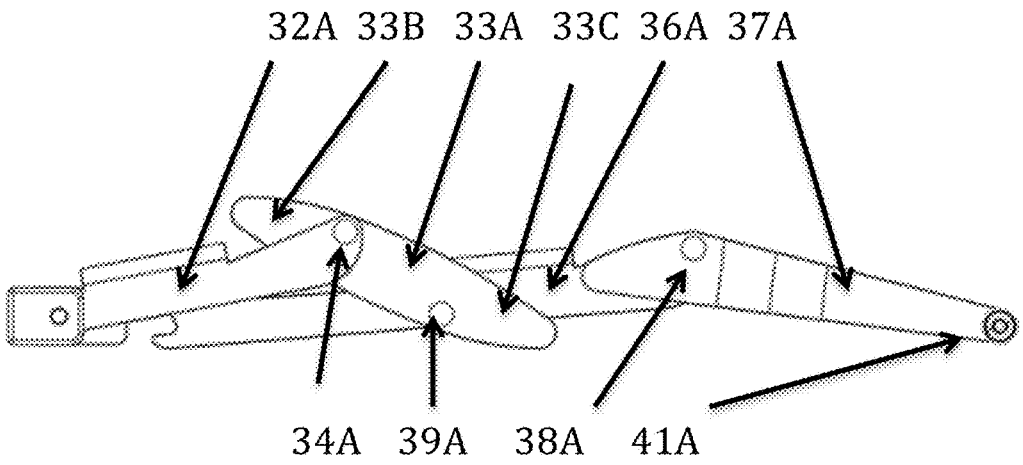

Turning to FIGS. 36-38, which reflect the first stage of the bed lift, the lifting force is generated from the first-stage linkages 32A, 33A that are pivoted to each other at pivot 34A. The first-stage linkage 33A is also pivotally connected to a second-stage linkage 36A at pivot 39A. The second-stage linkage 36A is pivotally connected to the second-stage linkage 37A at pivot 38A. The second-stage linkage 37A is also pivotally connected to the fixed (inner) portion 22 of the bed frame 20 at pivot 41A.

The first-stage linkage 33A has a lifting wing 33B and a control wing 33C. The lifting wing 33B engages the articulating portion 24 of the bed frame 20 and exerts a lifting force. The first-stage control wing 33C keeps in contact with the fixed (inner) portion 22 of the bed frame 20 during this stage.

As the actuator connected structure is moved horizontally out of the non-actuated position and into the first-stage actuated position, the first-stage lifting wing 33B exerts the lifting force on the articulating portion 24 of the bed frame 20 to lift same vertically as the control wing 33C remains in contact with the fixed (inner) portion of the bed frame 20. The second stage lift mechanism 35A may or may not make contact with the bed frame 20.

Figure 39:
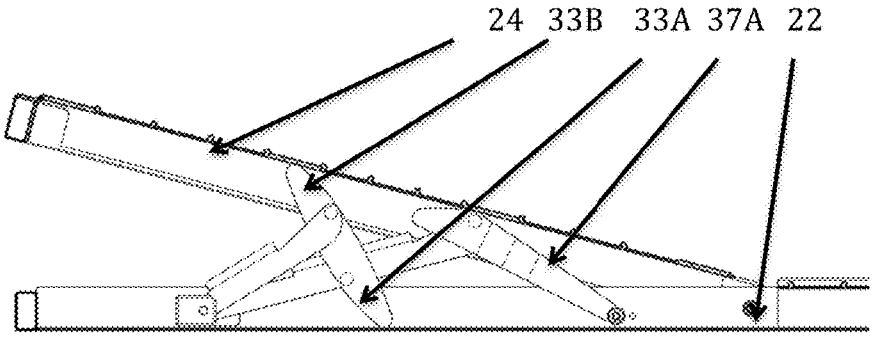
FIG. 39 is an elevation view of a transition in the bedframe as between the actuated first-stage of the double wing linkage embodiment of FIGS. 36-38 and an actuated second-stage of the double wing linkage embodiment.
Figure 40:
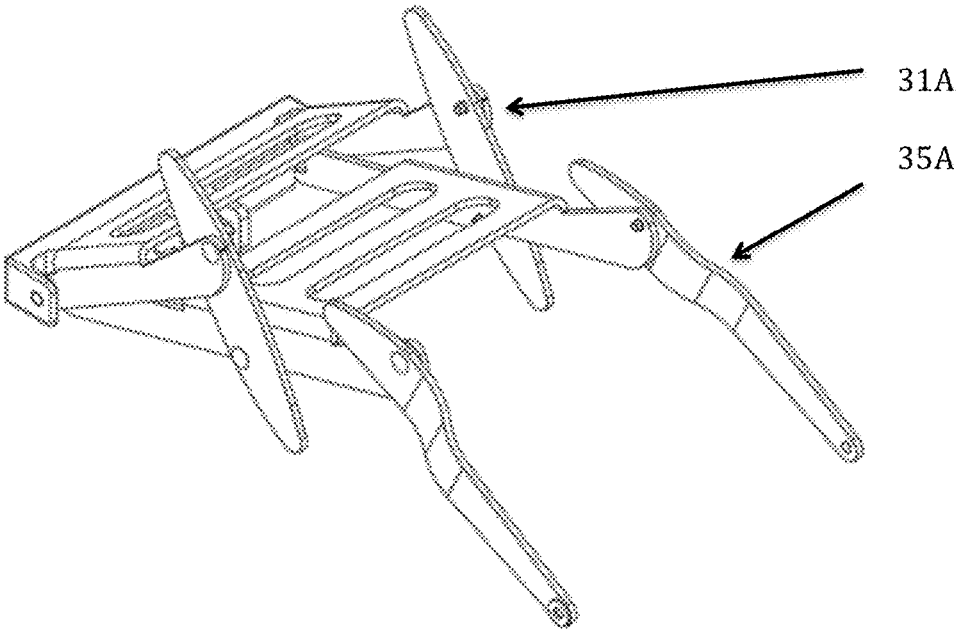
FIGS. 40 and 41 are respective isometric and elevation views showing a transition from the actuated first-stage to the actuated second-stage of the double wing linkage embodiment.
Figure 41:
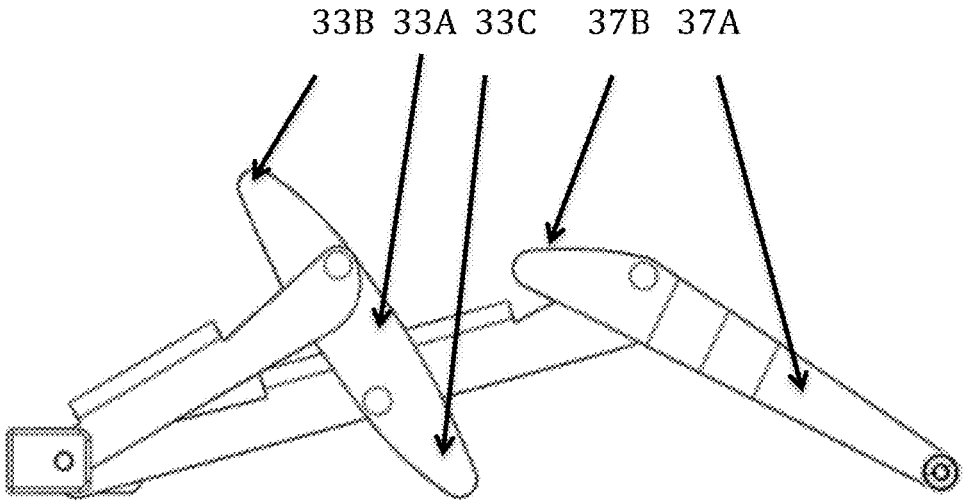

Turning to FIGS. 39-41, moving the actuator connected structure from the first-stage actuated position toward the second-stage actuation position gives rises to reaching a transition between the first-stage actuated position and the second-stage actuated position as shown. Such a transition takes place when the actuator connected structure 40 pushes into the second-stage linkages.

Figure 42:
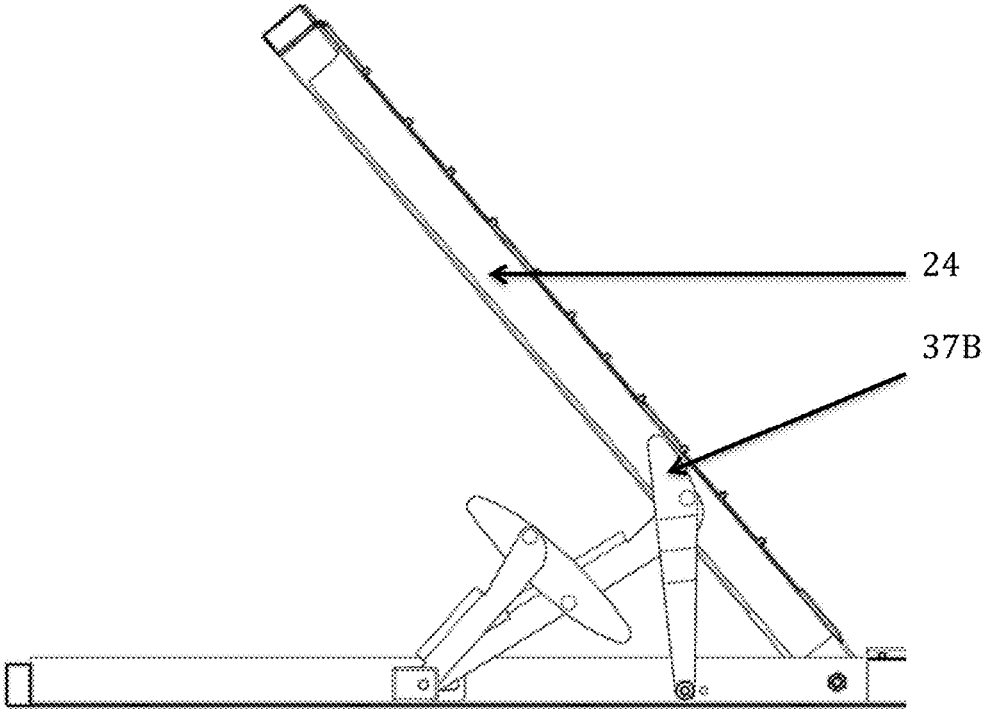
FIG. 42 is a cross section of the bedframe together with an elevation view of an actuated second-stage of the bed lift of FIG. 13 in accordance with the double wind articulated linkage embodiment of the invention.
Figure 43:
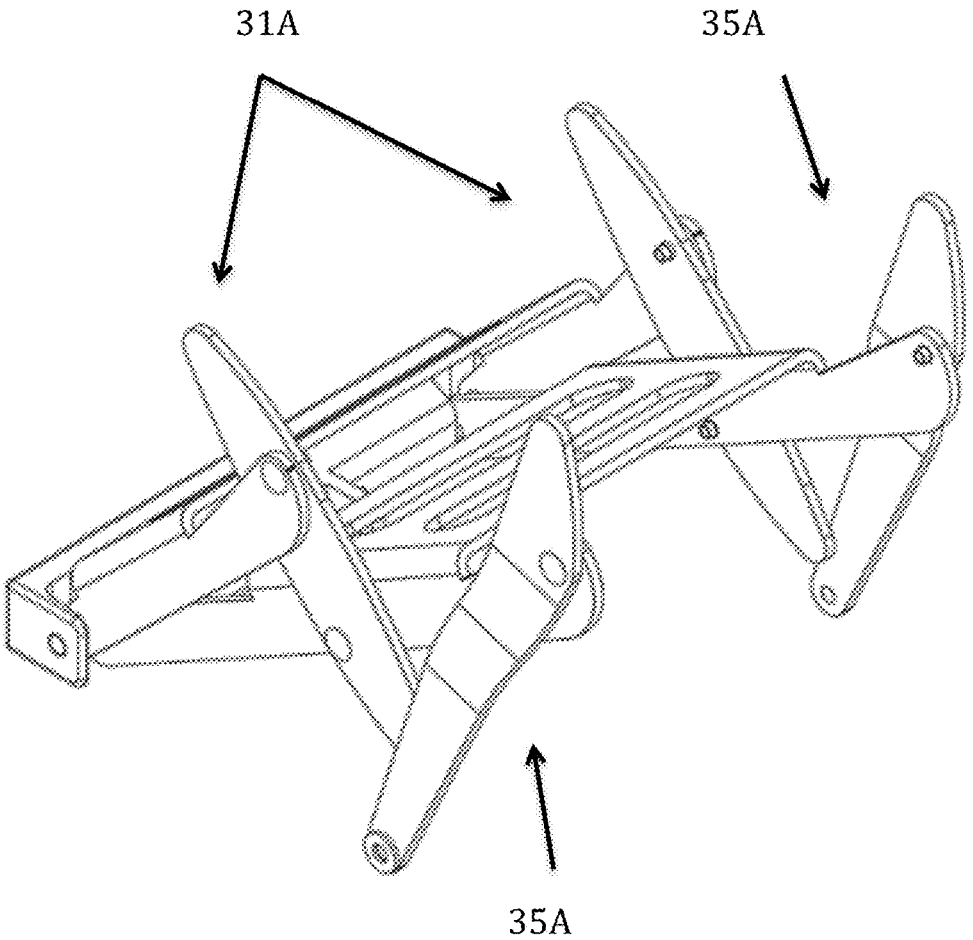
FIGS. 43 and 44 are respective isometric and elevation views of the bed lift of FIG. 42 except that the bed frame is omitted.
Figure 44:
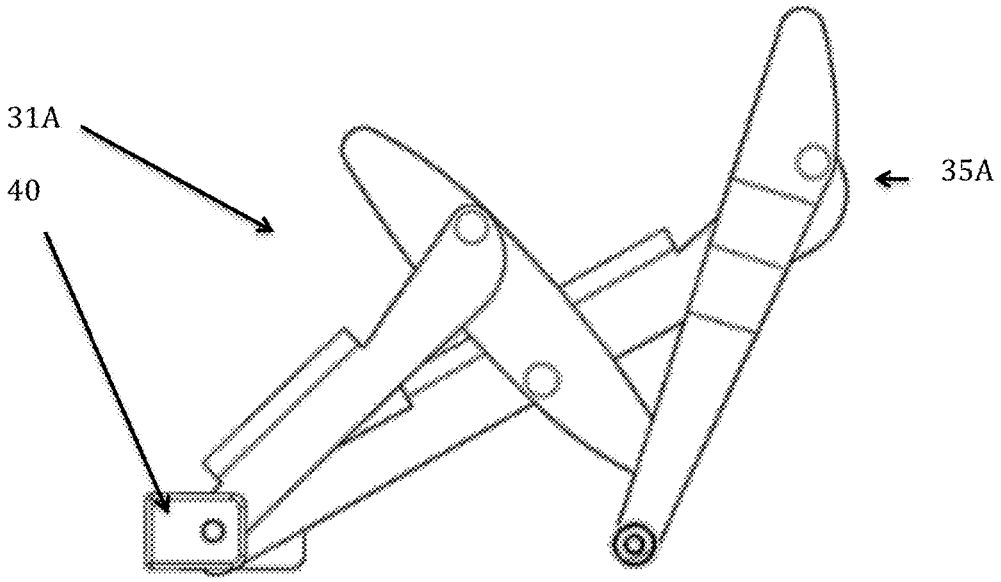

Turning to FIGS. 42-44, which depict the second stage of the bed lift 10 after the actuator connected structure reaches the second-stage actuated position, a second-stage lifting wing 37B exerts a lifting force on the articulating portion 24 of the bed frame 20. The first-stage lifting and control wings 33B no longer make contact with the bed frame 20 and all force is generated at the second-stage lifting wing 37B. The beginning of second-stage lift starts at the pivot point on the wing and the end of travel is at the tip of the wing.

FIGS. 43 and 44 show the double wing articulated linkage 30A alone after the actuator connected structure reaches the second-stage actuation position, except that FIGS. 43 and 44 omit depiction of the bed frame for the sake of mechanism clarity.

Simple "wall hugger" functionality arises for all the embodiments. Because the power layer is simply resting on a flat surface, simple sliding plates can be used underneath the power layer and its support surface in multiple locations to allow whole mattress articulation towards the wall, avoiding the need for a complete articulating subframe or frame rails.

While the foregoing description and drawings represent the preferred embodiments of the present invention, various changes and modifications may be made without departing from the scope of the present invention.

What is claimed is:

1. An adjustable bed lift, comprising:

a bed frame having a fixed portion and having an articulating portion pivotally connected to the fixed portion so that as the articulating portion pivots relative to the fixed portion, an angle of inclination changes between the articulating portion and the fixed portion;

a plurality of lift mechanisms that actuate successively to exert a respective lifting force on the articulating portion to widen the angle of inclination in succession; and actuator connected structure that moves relative to the fixed portion of the bed frame from a non-actuated position to successive actuated positions where the actuator connected structure triggers successive ones of the lift mechanisms to impart the respective lifting force on the articulating portion accordingly, wherein the plurality of lift mechanisms include a first-stage lift mechanism having first-stage linkages and include a second-stage lift mechanism having second-stage linkages;

wherein the actuator connected structure that is configured to move from a non-actuated position to a first-stage actuated position and then to a second-stage actuated position in succession, wherein as the actuator connected structure moves from the non-actuated position to the first-stage actuated position, the first-stage linkages pivot about a first-stage lift pivot, which contacts the articulating portion to exert a lifting force on the articulating portion of the bed frame that widens an angle of inclination between the articulating portion and the fixed portion from lifting of the articulating portion as a consequence of the first-stage linkages pivoting, wherein as the actuator connected structure moves from the first-stage actuated position to the second-stage actuated position, the second-stage linkages pivot about a second-stage lift pivot, which contacts the articulating portion to exert a further lifting force on the articulating portion of the bed frame that further widens the angle of inclination between the articulating portion and the fixed portion from further lifting the articulating portion as a consequence of the second-stage linkages pivoting in a manner in which the second-stage lift pivot exerts the further lifting force, and wherein the first-stage lift pivot is completely out of contact with the articulating portion as the second-stage lift pivot contacts the articulating portion in a manner that further lifts the articulating portion.

2. The adjustable bed lift of claim 1, wherein the first-stage lift pivot exerts at least a majority of the lifting force on the bed frame that lifts the bed frame with the actuator connected structure moved into the first-stage actuated position.

3. The adjustable bed lift of claim 2, wherein, with the actuator connected structure at the first-stage actuated position, the first-stage linkages bear a majority of the lifting force even with the second-stage linkages remaining in contact with the articulating portion of the bed frame.

4. The adjustable bed lift of claim 1, wherein the second-stage lift pivot is arranged to exert all of the further lifting force on the bed frame that further lifts the bed frame.

5. The adjustable lift of claim 1, wherein the first-stage lift pivot and the second-stage lift pivot are unattached to the articulating portion of the bed frame.

6. The adjustable lift of claim 1, wherein the first-stage lift pivot and the second-stage lift pivot are arranged to slide along an underside of the articulating portion of the bed frame.

7. The adjustable bed lift of claim 1, further comprising:

a third-stage lift mechanism having at least one third stage linkage, the actuator connected structure being arranged to move also from the second-stage actuated position to a third-stage actuated position;

wherein as the actuator connected structure moves from the second-stage actuated position to the third-stage actuated position, the third-stage linkages pivot about a third-stage lift pivot, which exerts an additional lifting force on the articulating portion of the bed frame that additionally widens the angle of inclination between the articulating portion and the fixed portion from additionally lifting the articulated portion as a consequence of the third-stage linkages pivoting in a manner in which the third-stage lift pivot exerts the additional lifting force, wherein the second-stage lift pivot is completely out of contact with the articulating portion as the third-stage lift pivot contacts the articulating portion in a manner that additionally lifts the articulating portion.

8. The adjustable bed lift of claim 7, wherein the bed frame has a slotted bracket, further comprising:

a wedge within a slot of the slotted bracket that is movable between two relative positions, one of the first-stage linkages connected to the wedge so as to move the wedge between the two relative positions as the first-stage linkage moves as a consequence of the actuator connected structure moving between the non-actuated position and the first-stage actuated position.

9. The adjustable bed lift of claim 8, wherein, with the actuator connected structure at the actuated first-stage position, the bed frame slotted bracket bears a majority of the lifting force for the bed frame even with the second-stage lift pivot being in contact with the articulating portion of the bed frame.

10. The adjustable bed lift of claim 8, wherein a majority of the lifting force exerted by the first-stage mechanism is located at the slotted bracket.

11. The adjustable bed lift of claim 7, wherein the third-stage pivot exerts all of the additional lifting force on the bed frame that additionally lifts the bed frame.

12. An adjustable bed lift, comprising:

a bed frame having a fixed portion and having an articulating portion pivotally connected to the fixed portion so that as the articulating portion pivots relative to the fixed portion, an angle of inclination changes between the articulating portion and the fixed portion;

a plurality of lift mechanisms that actuate successively to exert a respective lifting force on the articulating portion to widen the angle of inclination in succession; and an actuator connected structure that moves relative to the fixed portion of the bed frame from a non-actuated position to successive actuated positions where the actuator connected structure triggers successive ones of the lift mechanisms to impart the respective lifting force on the articulating portion accordingly, wherein the actuator connected structure that is configured to move from a non-actuated position to a first-stage actuated position and then to a second-stage actuated position in succession, wherein the plurality of lift mechanisms are arranged so that as the actuator connected structure moves from the non-actuated portion to the first-stage actuated position, the articulating portion of the bed frame lifts at a rate of speed that is slower than a rate of speed that the articulating portion of the bed frame lifts as the actuator connected structure moves from the first-stage actuated position to the second-stage actuated position in succession.

13. An adjustable bed lift, comprising:

a bed frame having a fixed portion and having an articulating portion pivotally connected to the fixed portion so that as the articulating portion pivots relative to the fixed portion, an angle of inclination changes that is between the articulating portion and the fixed portion;

a plurality of lift mechanisms that actuate to exert a respective lifting force, in succession, on the articulating portion to widen the angle of inclination in succession accordingly; and an actuator connected structure that moves relative to the fixed portion of the bed frame from a non-actuated position to at least one successive actuated position, wherein the plurality of lift mechanisms are responsive, in succession, to respective pushing forces exerted against the plurality of lift mechanisms in succession so as to impart, in succession, the respective lifting force on the articulating portion accordingly.

14. The adjustable bed lift of claim 1, wherein as the articulating portion of the bed frame pivots relative to first portion of the bed frame in response to exertion of the respective lifting force by successive ones of the lift mechanisms, the successive ones of the lift mechanisms are in contact with the articulating portion of the bed frame and preceding ones of the lift mechanisms are no longer in contact with the articulating portion of the bed frame.

15. The adjustable bed lift of claim 1, wherein the plurality of lift mechanisms include linkages in a substantially flattened condition within confines of the bed frame as the actuator connected structure resides in the non-actuated position.

16. The adjustable bed lift of claim 1, wherein the bed frame includes a fixed frame portion and an articulating frame portion, wherein the articulating frame portion changes an angle of inclination with the fixed frame portion as the actuator connected structure moves from the non-actuated position to the first-stage actuated position and then to the second-stage actuated position.

17. The adjustable bed lift of claim 1, wherein the successive actuated positions include a first-stage actuated position and a second-stage actuated position, the plurality of lift mechanisms include first-stage linkages and second-stage linkages respectively, the first-stage linkages and the second-stage linkages being responsive to exertion of the respective pushing forces to lift as the actuator connected structure moves from a first-stage actuated position to a second-stage actuated position.

18. The adjustable lift of claim 1, wherein the actuator connected structure is arranged substantially in parallel to a mattress surface of a mattress on the bed frame when the bed frame is substantially flat within a few degrees.

19. The adjustable lift of claim 1, wherein the actuator connected structure includes an actuator so that when being fully actuated, the actuator pivots over a full range of actuations all within the confines of a thickness of the bedframe.

20. The adjustable lift of claim 1, wherein all moving components of the articulating portion of the bed frame are confined to being above a bottom surface of the fixed portion of the bedframe during all stages of travel of the first-stage lift pivot and the second-stage lift pivot as the articulating portion of the bed frame raises.

21. The adjustable lift of claim 1, wherein the lift mechanisms have associated linkages that are nested with each other.

22. The adjustable lift of claim 1, wherein the plurality of lift mechanisms include a lift mechanism having at least one linkage that with one end portion arranged to come into contact with at least one of the articulating portion of the bed frame and the fixed portion of the bed frame to exert the pushing force that widens the angle of inclination between the fixed portion of the bed frame and the articulating portion of the bed frame.

23. The adjustable lift of clam 1, wherein the plurality of lift mechanisms include a lift mechanism having at least one linkage that has opposite end portions that are in contact respectively and simultaneously with the articulating portion of the bed frame and the fixed portion of the bed frame so as to exert the pushing force that widens the angle of inclination between the fixed portion of the bed frame and the articulating portion of the bed frame.

24. The adjustable lift of claim 23, wherein the first-stage lift mechanism and the second-stage lift mechanism each have a further linkage pivotally connected to each other, the linkage of the second-stage lift mechanism that exerts the pushing force being pivotally connected to the fixed portion of the bed frame.

25. The adjustable lift of claim 23, wherein the lift mechanism that has the at least one linkage constitutes a second-stage lift mechanism, the plurality of lift mechanisms also including a first-stage lift mechanism configured to actuate before the second-stage lift mechanism, the first-stage lift mechanism having at least one linkage that pushes the second-stage lift mechanism to cause the linkage of the second-stage lift mechanism to exert the pushing force.

26. The adjustable lift of claim 25, wherein the first-stage lift mechanism and the second-stage lift mechanism are each arranged to pivot in succession as the actuator connected structure moves from the first-stage actuated position to the second-stage actuated position in a manner that triggers the at least one linkage of the second-stage lift mechanism to exert the pushing force.

27. An adjustable bed lift, comprising:

a bed frame having a fixed portion and having an articulating portion pivotally connected to the fixed portion so that as the articulating portion pivots relative to the fixed portion, an angle of inclination changes between the articulating portion and the fixed portion;

a plurality of lift mechanisms that actuate successively to exert a respective lifting force on the articulating portion to widen the angle of inclination in succession; and an actuator connected structure that moves relative to the fixed portion of the bed frame from a non-actuated position to successive actuated positions where the actuator connected structure triggers successive ones of the lift mechanisms to impart the respective lifting force on the articulating portion accordingly, wherein as the actuator connected structure is configured to be driven in reverse to lower the bed frame, the articulating portion of the bed frame is configured to be driven down by gravity in lieu of being forced down by the actuator connected structure.

28. An adjustable bed lift, comprising:

a bed frame having a fixed portion and having an articulating portion pivotally connected to the fixed portion so that as the articulating portion pivots relative to the fixed portion, an angle of inclination changes that is between the articulating portion and the fixed portion;

a plurality of lift mechanisms that actuate in a successive manner to exert a respective lifting force on the articulating portion to widen the angle of inclination in succession; and an actuator connected structure that moves relative to the fixed portion of the bed frame from a non-actuated position to at least one successive actuated position, wherein the actuator connected structure triggers successive ones of the lift mechanisms to each impart the respective lifting force against the articulating portion in a successive manner.

* * * * *